United States Patent [19]

Stadler et al.

[11] Patent Number: 4,936,419

[45] Date of Patent: Jun. 26, 1990

[54] ELEVATOR DIAGNOSTIC DISPLAY SYSTEM

[75] Inventors: Paul A. Stadler, East Moline, Ill.; Michael Bajc, Davenport, Iowa

[73] Assignee: Montgomery Elevator Co., Moline, Ill.

[21] Appl. No.: 263,032

[22] Filed: Oct. 26, 1988

[51] Int. Cl.[5] ..... B66B 3/00

[52] U.S. Cl. ..... 187/133

[58] Field of Search ..... 187/101, 130, 133

[56] References Cited

U.S. PATENT DOCUMENTS 4,397,377 8/1983 Husson et al. ..... 187/101 X 4,698,780 10/1987 Mandel et al. ..... 187/130 X 4,823,914 4/1989 McKinney et al. ..... 187/133

*Primary Examiner*—A. D. Pellinen

*Assistant Examiner*—W. E. Duncanson, Jr.

*Attorney, Agent, or Firm*—Wood, Phillips, Mason, Recktenwald & Vansanten

[57] ABSTRACT

A diagnostic display system for indicating the status of elevator system operating conditions develops signals representing each operating condition and detects when a car is delayed in responding to a request for service. Signals representing each operating condition are stored when a delayed car response is detected so that the status of the operating conditions as they were at the time of delayed car response can be displayed at a later time.

16 Claims, 8 Drawing Sheets

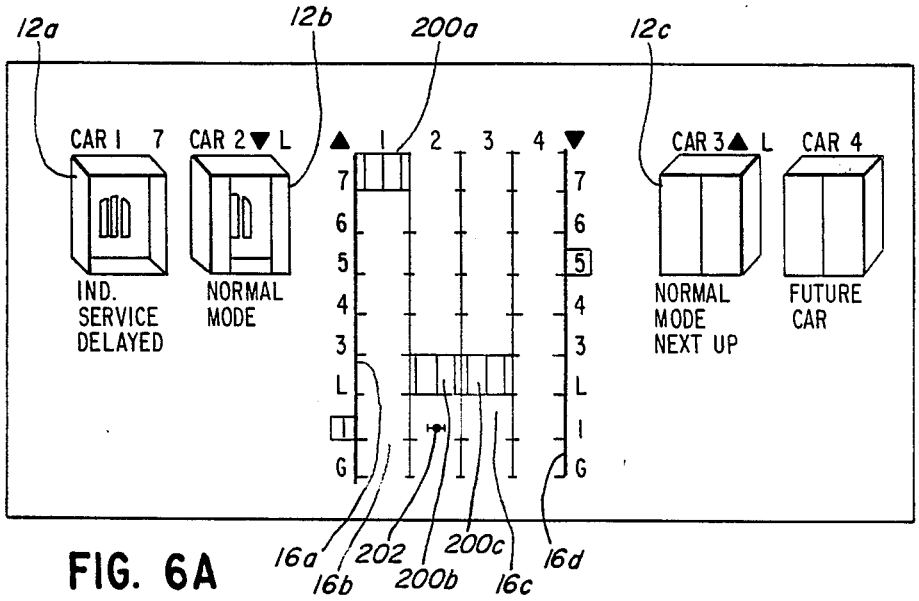

FIG. 6A

CAR 1 DISPATCH EVENT

EVENT BEGAN 01:02:34 PM WED MAY 11, 1988
EVENT ENDED 01:14:49 PM WED MAY 11, 1988

PROBABLE CAUSE OF EVENT → INDEPENDENT SERVICE

CAR GATE OPEN
SAFETY EDGE NORMAL
DOOR OPEN BUTTON NOT PUSHED
DOOR NOT OBSTRUCTED
DOOR TIMER NOT HOLDING DOOR OPEN
CAR NOT FULLY LOADED
SAFETY STRING OK

DOOR OPERATOR FULLY OPEN
DOOR OPERATOR NOT FULLY CLOSED
CAR NOT TIMED OUT OF SERVICE
CAR IS POWERED UP

DOOR GATE OPEN
PHOTO CELL NOT BROKEN
DOOR CLOSE BUTTON NOT PUSHED
CAR LEVEL AT FLOOR
STOP SWITCH IN RUN POSITION
CAR NOT MOVING
CAR IN INDEPENDENT SERVICE
SHUTDOWN SWITCH NOT THROWN
CAR NOT IN INSPECTION MODE
CAR NOT IN FIRE SERVICE

FIG. 6B

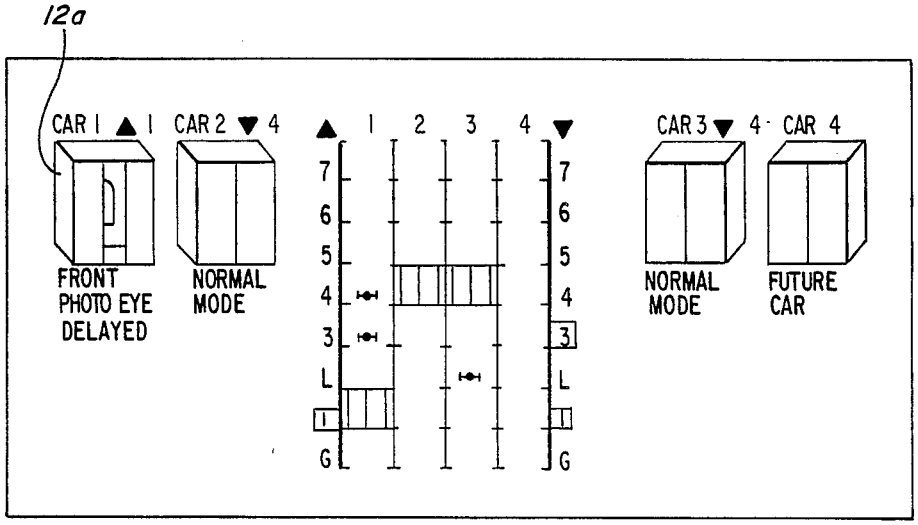

FIG. 6C

CAR 1 DISPATCH EVENT

EVENT BEGAN 01:27:02 PM WED MAY 11, 1988
EVENT ENDED 01:27:04 PM WED MAY 11, 1988

PROBABLE CAUSE OF EVENT → FRONT PHOTOCELL

CAR GATE OPEN
SAFETY EDGE NORMAL
DOOR OPEN BUTTON NOT PUSHED
DOOR NOT OBSTRUCTED
DOOR TIMER NOT HOLDING DOOR OPEN
CAR NOT FULLY LOADED
SAFETY STRING OK

DOOR OPERATOR NOT FULLY OPEN
DOOR OPERATOR NOT FULLY CLOSED
CAR TIMED OUT OF SERVICE
CAR IS POWERED UP

DOOR GATE OPEN
PHOTO CELL BROKEN
DOOR CLOSE BUTTON NOT PUSHED
CAR LEVEL AT FLOOR
STOP SWITCH IN RUN POSITION
CAR NOT MOVING
CAR NOT IN INDEPENDENT SERVICE
SHUTDOWN SWITCH NOT THROWN
CAR NOT IN INSPECTION MODE
CAR NOT IN FIRE SERVICE

FIG. 6D

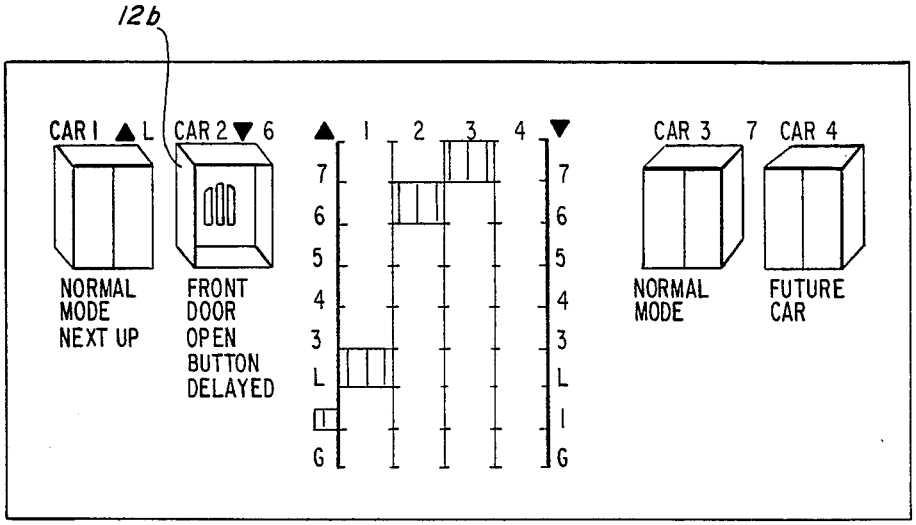

FIG. 6E

CAR 2 DISPATCH EVENT

EVENT BEGAN 04:41:56 PM WED MAY 11, 1988
EVENT ENDED 04:42:37 PM WED MAY 11, 1988

PROBABLE CAUSE OF EVENT → FRONT DOOR OPEN BUTTON

CAR GATE OPEN
SAFETY EDGE NORMAL
DOOR OPEN BUTTON PUSHED
DOOR NOT OBSTRUCTED
DOOR TIMER NOT HOLDING DOOR OPEN
CAR NOT FULLY LOADED
SAFETY STRING OK

DOOR OPERATOR FULLY OPEN
DOOR OPERATOR NOT FULLY CLOSED
CAR TIMED OUT OF SERVICE
CAR IS POWERED UP

DOOR GATE OPEN
PHOTO CELL NOT BROKEN
DOOR CLOSE BUTTON NOT PUSHED
CAR LEVEL AT FLOOR
STOP SWITCH IN RUN POSITION
CAR NOT MOVING
CAR NOT IN INDEPENTENT SERVICE
SHUTDOWN SWITCH NOT THROWN
CAR NOT IN INSPECTION. MODE
CAR NOT IN FIRE SERVICE

FIG. 6F

ELEVATOR DIAGNOSTIC DISPLAY SYSTEM

TECHNICAL FIELD

The present invention relates generally to elevator systems, and more particularly to a diagnostic system for an elevator control which is capable of displaying the status of elevator operating conditions as they existed at the time of a delay in responding to a request for elevator service.

BACKGROUND ART

Elevator systems which include an elevator control that controls one or more elevator cars servicing landings in a building typically include sensors of various types which provide information as to the status of operating conditions in the system. For example, door interlock and limit switches are typically provided to indicate when elevator car and hall doors are opened or closed and to indicate when the car is at its extreme lowermost or uppermost positions in the hoistway. Further, sensors are utilized which detect the load carried by the elevator car, the speed of the elevator car while traveling in the hoistway, when the elevator car is level at a landing, etc.

In addition to the foregoing sensors, switches are typically provided which, when actuated, affect the operation of the elevator car. For example, a door open switch is usually provided which, when actuated, opens the elevator and hall doors, at which time the elevator is prevented from moving. Also, a door photo switch and a safety edge are typically provided for each set of car doors which detect an obstruction preventing closure of the car and hall doors.

There are also various switches which are provided to stop the elevator or to allow inspection of the various mechanisms and cables.

At times, it may occur that a request for elevator service is issued yet the car is delayed in responding to such service request. This may be due to, for example, the detection of a fault condition, the detection of an unsafe or potentially unsafe condition, an obstruction in the car or hall doors, an actuation of the stop switch or the like. Such delays can be substantial in length, thereby resulting in inconvenience to users.

It would be useful to ascertain the cause(s) of a delay in responding to a request for service for various reasons. Chiefly, the source of a delay may identify a problem or potential problem with an elevator component. Alternatively, the cause of the delay may indicate the occurrence of abnormal conditions or activity external of the elevator system itself. Two examples of the latter are where a vandal has propped a stick or other obstruction between the elevator doors to prevent full closure of same or where seismic activity has caused the elevator to track incorrectly in the hoistway.

Knowledge of the cause of a delay event can also be informative of passenger habits and can lead to useful system adjustment information. For example, when a car is delayed an excessive number of times in responding to requests for service due to actuation of the door open button, it may be considered desirable to increase the door open time to allow entry and exit of more passengers without the need to actuate the door open button.

Thus, it can be seen that knowledge of the cause of a delay event can be useful for various reasons.

It is well proven to provide an indication of the operating status of an elevator system in "real time" in which information is provided concerning the current operating conditions. Such a "real time" indication, however, is generally of limited benefit since a technician must digest a great deal of information before useful conclusion can be drawn or he must, by chance, be present to note operating conditions during the occurrence of a fault or other event. Even in the latter case, the indication of the occurrence of an event may be short-lived, and hence the technician may be unable to obtain sufficient useful information to enable accurate diagnosis of the event cause.

SUMMARY OF THE INVENTION

In accordance with the present invention, a diagnostic system for an elevator control permits a service technician or building owner to determine the status of selected elevator operating conditions as they were upon the occurrence of one or more delay events, at a time subsequent thereto, so that the cause of the delay event can be ascertained.

More particularly, a diagnostic display system for indicating the status of elevator system operating conditions wherein the system includes elevator cars which respond to requests for service and wherein the status of one or more of a plurality of operating conditions of the elevator system may delay car response includes means for developing signals representing each operating condition, means responsive to the developing means for detecting a delay of car response, means responsive to the detecting means for storing the signals representing each operating condition when a delayed car response is detected and means coupled to the storing means for indicating the status of the operating conditions as they were at the time of a delayed car response.

In the preferred embodiment, the indicating means includes means for displaying the status of the operating conditions in more than one screen format on a video display terminal (VDT). Preferably, the display formats include text and graphics formats which are designed to facilitate understanding of the information.

The indicating means also provides an indication of the probable cause of the delay event. This is useful to assist service personnel or other users in determining what corrective action might be taken to reduce the number of future delay events.

Thus, a technician can view, on demand, elevator conditions as they were at the time of one or more delay events so that useful conclusions can be drawn therefrom.

BRIEF DESCRIPTION OF THE DRAWINGS

FIGS. 6A–6F are diagrams illustrating the appearance of the screen of the VDT in graphics and text formats for each of a plurality of delay events.

DESCRIPTION OF THE PREFERRED EMBODIMENTS

Figure 1:
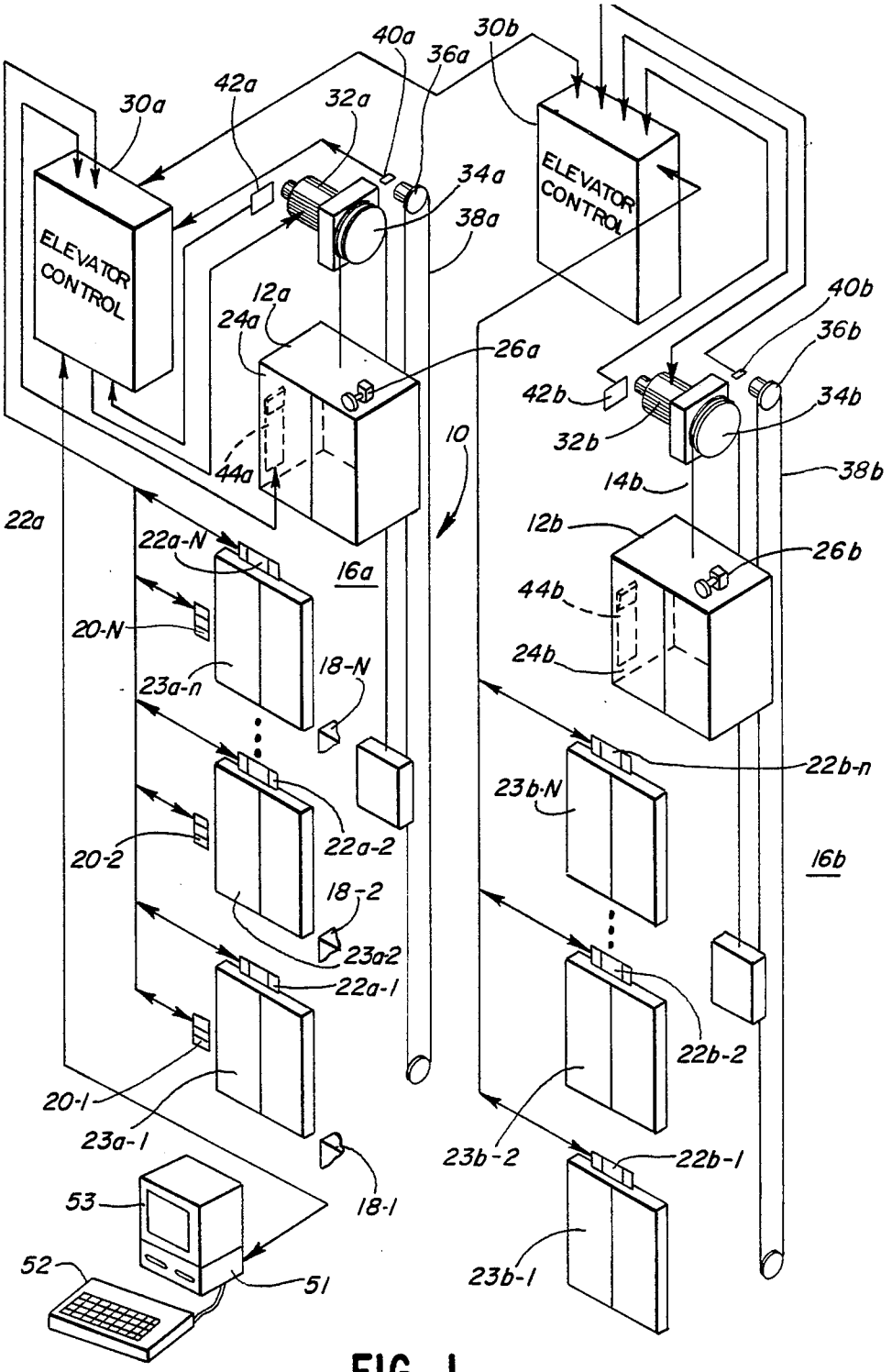
FIG. 1 is a block diagram of an elevator system.

Referring now to FIG. 1, an elevator system 10 shown in simplified form includes one or more elevator cars, for example 12*a* and 12*b* suspended by cables 14*a* and 14*b* in hoistways 16*a* and 16*b*, respectively. It should be noted that the elevator system may include a different number of elevator cars each suspended within a hoistway by cables, as required by the building size. The elevator cars 12*a*, 12*b* serve a plurality of landings or floors, 18-1, 18-2 . . . 18-N. Disposed at each floor 18-1 through 18-N is a hall call station 20-1, 20-1 . . . 20-N, respectively, at which a user may request elevator service (hereinafter "hall calls") and at which an acknowledgment of a request for elevator service is displayed. In addition, position indicators (PI's) 22*a*-1 through 22*a*-N and 22*b*-1 through 22*b*-N may be provided at the floors 18-1, 18-2 . . . 18-N, adjacent hall doors 23*a*-1 through 23*a*-N and 23*b*-1 through 23*b*-N, respectively, to indicate the position of the cars 12*a* and 12*b* within the hoistways 16*a* and 16*b*.

The PI's 22 may be dispensed with or may be used only at selected floors, if desired. Alternatively, some or all of the PI's may be replaced by directional indicators and/or gongs which announce the arrival of an elevator car at the landing and the direction the car will travel when it leaves the landing.

Each elevator car 12*a*, 12*b* carries at least one set of car doors or gates 14*a* or 14*b* which are movable in a range of positions between fully opened and fully closed by a door operator 26*a* or 26*b*, respectively. The door operators 26*a*, 26*b* also open and close the hall doors 23 by means of a mechanical interlock (not shown) which is engaged when one set of car doors 24*a* or 24*b* is aligned with one of the hall doors 23*a*-1 through 23*a*-N or 23*b*-1 through 23*b*-N, respectively, when the elevator car 12*a* or 12*b* is level at a floor 18-1, 18-2 . . . 18-N.

Each car may alternatively include two sets of car doors which cooperate with hall doors to permit access to the elevator car from different directions. In this case, the sets of doors are arbitrarily referred to as "front" and "rear" doors.

The hall call stations 20 and PI's 22-1 through 22*a*-N are coupled to a first elevator control 30*a* which may be disposed in a machine room or at another location remote from the elevator cars 12. The elevator control 30 controls a first motor 32*a* which in turn rotates a sheave 34*a* over which cables 14*a* extend so as to control the movement of the car 12*a* in the hoistway 16*a*.

A further elevator control 30*b* is coupled to the first elevator control 30*a* and is responsive to commands issued thereby. The control 30*b* controls a motor 32*b* which rotates a sheave 34*b* over which cables 14*b* extend so as to control the movement of the car 12*b* in the hoistway 16*b*.

Mechanical speed governors, 36*a*, 36*b* are attached by further cables 38 to the elevator cars 12*a*, 12*b*. The governors 36*a*, 36*b* prevent the elevator cars 12*a*, 12*b* from reaching an overspeed condition. Position sensors 40*a*, 40*b* detect rotation of the governors 36*a*, 36*b* and provide car position information to the elevator controls 30*a*, 30*b*. Signals representing the speeds of the motors 32*a*, 32*b* are also provided to the controls 30*a*, 30*b* by tachometers 42*a*, 42*b*.

The elevator controls 30*a*, 30*b* are coupled to car control panels 44*a*, 44*b* disposed in the cars 12*a*, 12*b*. The control panels 44*a*, 44*b* include buttons for entering requests for elevator service (hereinafter "car calls") and may display acknowledgements of such requests as well as the current position and direction of movement of the cars 12*a*, 12*b*, respectively. Each control panel 44 may also include other buttons or switches (not shown in FIG. 1) such as a stop switch, a door open button, a door close button, an independent service switch, a shutdown switch, a fireman's control switch and an inspection mode switch.

In addition to the foregoing buttons or switches, a hatch access switch (also not shown in FIG. 1) may be provided adjacent one or more sets of hall doors. Actuation of a hatch access switch permits a set of hall doors to be opened so that service personnel can move a car in the hoistway in the vicinity of the floor at which the access switch is located. A hall shutdown switch may be provided at one or more floors, typically at the first or ground floor, which, when actuated, completely disables an associated elevator car. A fire switch may further be provided at the first or ground floor (and at other floors, if desired) to permit fire and rescue personnel to assume command of one or more cars.

Figure 2:
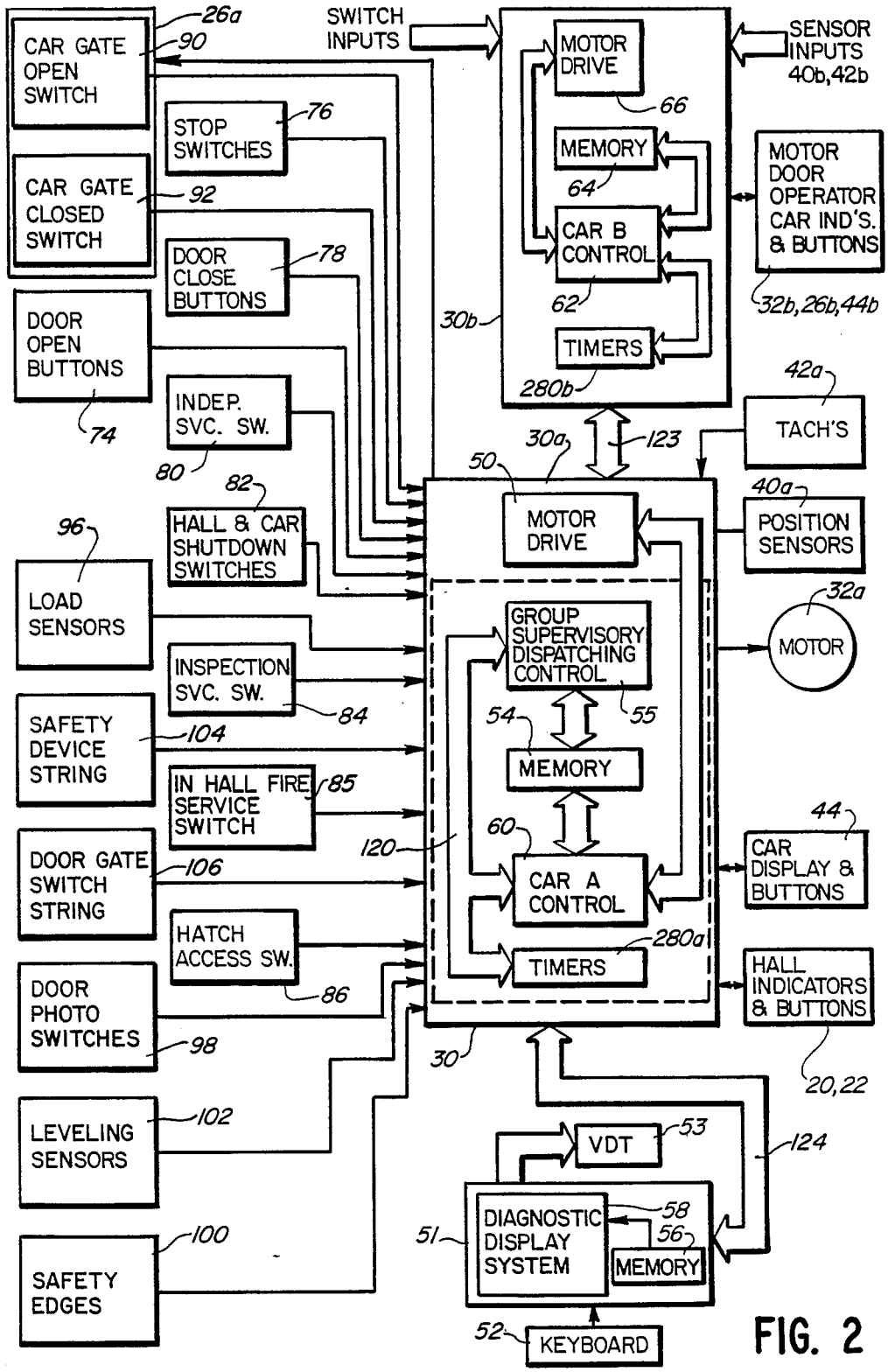
FIG. 2 is a block diagram of the elevator controls illustrated in FIG. 1 and a diagnostic display system according to the present invention.

Referring now to FIG. 2, there is illustrated in block diagram form the elevator controls 30*a*, 30*b* shown in FIG. 1. The control 30*a* includes a motor drive unit 50 which controls the application of power to the motor 32*a*. The control 30*a* is coupled to a processing unit 51, which may be implemented by a commercially available personal computer. The processing unit 51 receives user commands from a keyboard 52 and is coupled to a video display terminal (VDT) 53. The control 30*a* executes programming tasks stored in a memory 54, under control of a commercially available operating system, such as Intel's RMX system, to implement a group supervisory control 55. The group supervisory control 55 (hereinafter the "common") coordinates the operation of the elevator cars 12 in one of a plurality of common operating modes. A first common operating mode is referred to as a "balanced" mode in which the common 55 assigns each car to service requests based upon car availability, proximity of the car to the floor from which the request was issued, direction of travel of the car at the time a request for service is issued, etc . . . . In this mode, no attempt is made by the common to return all cars to any particular floor once all requests have been serviced. On the other hand, in an "up peak" mode, the common instructs each elevator car to return to a particular floor (typically the ground level floor) when no remaining requests are to be serviced by such car so that the elevator cars are made available at the floor at which they are most needed. Other common operational modes are typically implemented by the common 55, as should be evident to one skilled in the art.

The common also detects the occurrence of a "delay event" which is defined as the occurrence of an elevator operating condition which results in a delay in responding to a request for elevator service. A delay event may be initiated by any one or more of a number of conditions, including sensing of a fault condition, actuation of a button or switch by a service technician or other person which results in a delay in car response, detection of an obstruction in the car doors preventing full closure of same, etc. The common 55, upon detection of a delay event, issues an interrupt which causes information to be sent to the processing unit 51. The processing unit 51 then executes programming stored in a memory 56 to implement the diagnostic display system 58 of the persent invention. The display system 58 stores the status of various elevator operating conditions in the memory 56 in a fashion to be described in greater detail hereinafter.

The control 30*a* further executes other operating system tasks under control of programming also stored in the memory 54 to implement a car control 60 which controls the movement of the car 12*a*. The common 55 issues dispatching related positioning commands to car controls 60 and through communication links 120 and 123 which cause each control, as required, to control the movement of the cars 12*a* and 12*b*. Information concerning the position of the car 12*b*, and information concerning all other dispatching related inputs of car 12*b*, is provided to the common 55 by the control 30*b* over communications link 123. The control 30*b*, like the control 30*a*, further includes a memory 64 and a motor drive 66. Also coupled to each control 30*a*, 30*b* are the various buttons and switches associated with the elevator cars and described above; however, only the buttons and switches associated with the control 30*a* are specifically shown. These devices are the door open button 74, the stop switches 76, the door close button 78, the independent service switch 80, the hall and car shut down switches 82, the inspection service switches 84 and the hatch access switches 86. In addition to the foregoing, the control 30*a* receives signals from car gate open and closed switches 90, 92, respectively, on door operator 26*a* which indicate the open/closed status of the car doors or gates 24, a load sensor 96 which develops signals representing the loads carried by the elevator car 12*a* and a pair of door photo switches or cells 98 and safety edges 100 which together prevent closure of the doors if an obstruction is detected. Further, leveling sensor switches 102 are provided in association with each elevator car and develop a car level signal when such car is level at a landing.

The control 30*a* further tests a plurality of safety devices 104 and door gate sensing devices 106, each of which are connected in series and which are hereinafter referred to as a safety device string and a door gate switch string, respectively. The safety device string 104 may comprise, for example, sensor controlled relays having contactors which are opened when a governor overspeed condition is detected, when an over travel limit switch has been opened due to over travel of an elevator car in the hoistway, when a pit stop switch has been actuated due to the presence of an elevator car in the hoistway pit, etc.

The control 30*b* receives inputs identical to the foregoing devices and associated with the elevator car 12*b*, with the exception of the in hall fire service switch 84 and hall buttons 20 which are connected to control 30*a* for use by the common processing software.

Figure 3:
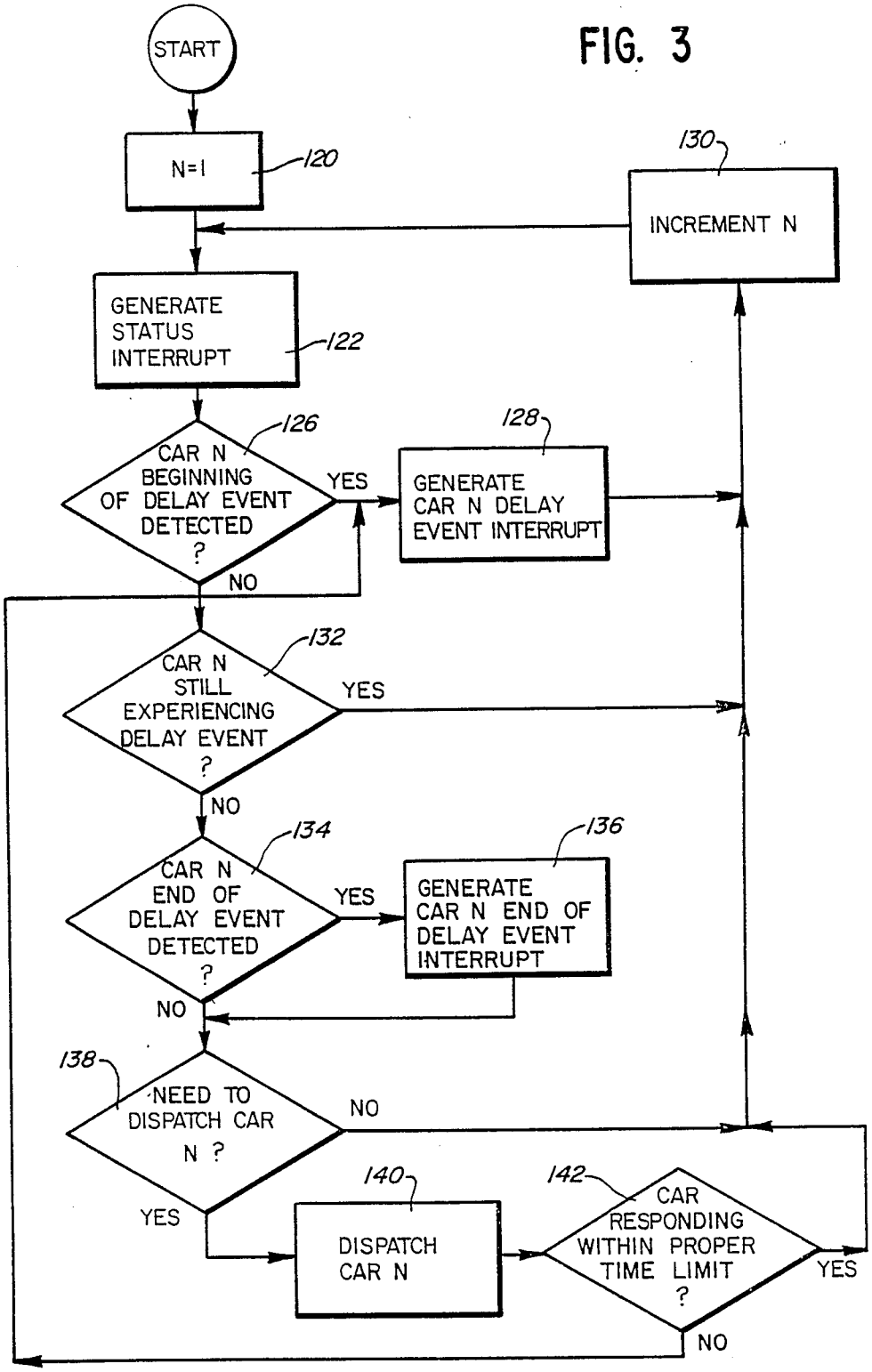
FIG. 3 comprises a flow chart of a portion of the programming executed by the group supervisory dispatching control illustrated in FIG. 2 to detect the existence of a delay event to the diagnostic display system illustrated in FIG. 2.

Referring now to FIG. 3, there is illustrated a portion of the programming executed by the common 55. The programming illustrated in FIG. 3 results in the generation of interrupts which in turn cause the diagnostic display system 58 to store data in the memory 56 including data representing the status of various operating conditions. The program illustrated in the Figure is executed for each of the elevator cars in successive fashion. The program begins at a block 121 which sets the value of a loop counter N equal to one. A block 122 then generates an interrupt which causes any new current operating condition status(es) of the entire elevator group, as stored in the memory 54, to be transmitted over a communications link 124, FIG. 2, to the display system 58, causing the system 58 to store the new status(es).

Following the block 122, a block 126 checks to determine whether the beginning of a delay event for car N=1 is occurring. If this is the case, a block 128 generates a delay event interrupt which causes the display system 58 to store the current status of operating conditions in a particular portion of the memory 56. Control thereafter passes to a block 130 which increments the loop counter N. Control then returns to the block 122.

If the block 126 does not detect the beginning of a delay event, a block 132 checks to determine whether the the first car is still experiencing a delay event. If so, control passes to the block 130 where the loop counter is incremented. Otherwise, a block 134 checks to determine whether an end of a delay event for the car N has been detected. If so, a block 136 generates a third interrupt representing the end of the delay event for this car and control passes to a block 138.

The block 138 determines whether there is a need to dispatch the first car in response to a request for service. If there is such a need, a block 140 dispatches the car and a block 142 checks to determine whether the car responds to such dispatching within a certain time limit. If the car does not respond within the certain time limit, then it has been determined that a delay event has been initiated and control passes to the block 128 which generates the delay event interrupt.

If the block 138 determines that there is no need to dispatch the first car or if the first car responds within the certain time limit to the dispatch command, control passes to the block 130 which increments the loop counter N.

Subsequent passes through the program of FIG. 3, detect the occurrence of delay events for the other cars in the system.

Figure 4A:
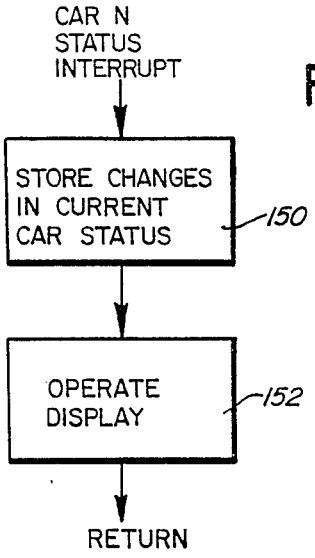
FIGS. 4A–4C are flow charts of programming executed by the diagnostic display system of FIG. 2 in response to interrupts generated by the common dispatching control.
Figure 4B:
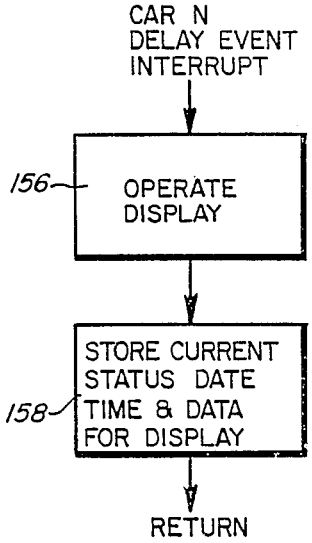
Figure 4C:
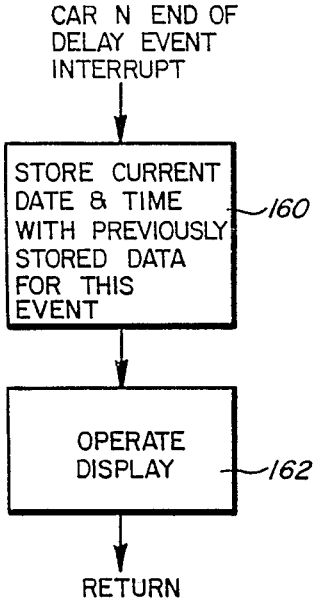

Referring now to FIGS. 4*a*–4*c*, there is illustrated programming executed by the diagnostic display system 58 in response to the interrupts generated by the blocks 122, 128 and 136. It should be noted that the system 58 may alternatively be implemented in whole or in part by the control 30*a*. With particular reference initially to FIG. 4*a*, when the status interrupt is generated by the block 122, a block 150 detects any changes in system status since such status was last detected and stores such changes in the memory 56. A block 152 then operates the VDT 53 to display the updated status of the elevator system on a real time basis (hereinafter the "real time display mode") is a first or graphics format. Thus, at any instant, an operator may view this real time display screen to observe the elevator group operating status. Following execution of the block 152, control returns to the main operating program of the diagnostic display system 58.

Once the delay event interrupt is developed by the block 128, control of the diagnostic display system 58 passes to a block 156 which operates the VDT 53 to provide an indication that car N is delayed in responding to a request for service. A block 158 then stores in the memory 56 the current status relative to such car as well as the status of other relevant system operating conditions, the current time and date and the data needed to display such information on the VDT 53 in the first or graphics format. Control thereafter returns to the appropriate point in the main program for the display system 58.

Referring now to FIG. 4c, when the end of delay event interrupt is generated by the block 136, the current date and time are stored in the memory 54 with the data which was originally stored by the block 158, FIG. 4b. Thus, the memory 56 stores the time and date at which a delay event occurred, the time and date at which the delay event ended and the date needed to display the status of system operating conditions at the time of the delay event. A block 162 then operates the display in the real time display mode to remove the delay indication which was caused to appear on the VDT 53 by the block 156.

Figure 5:
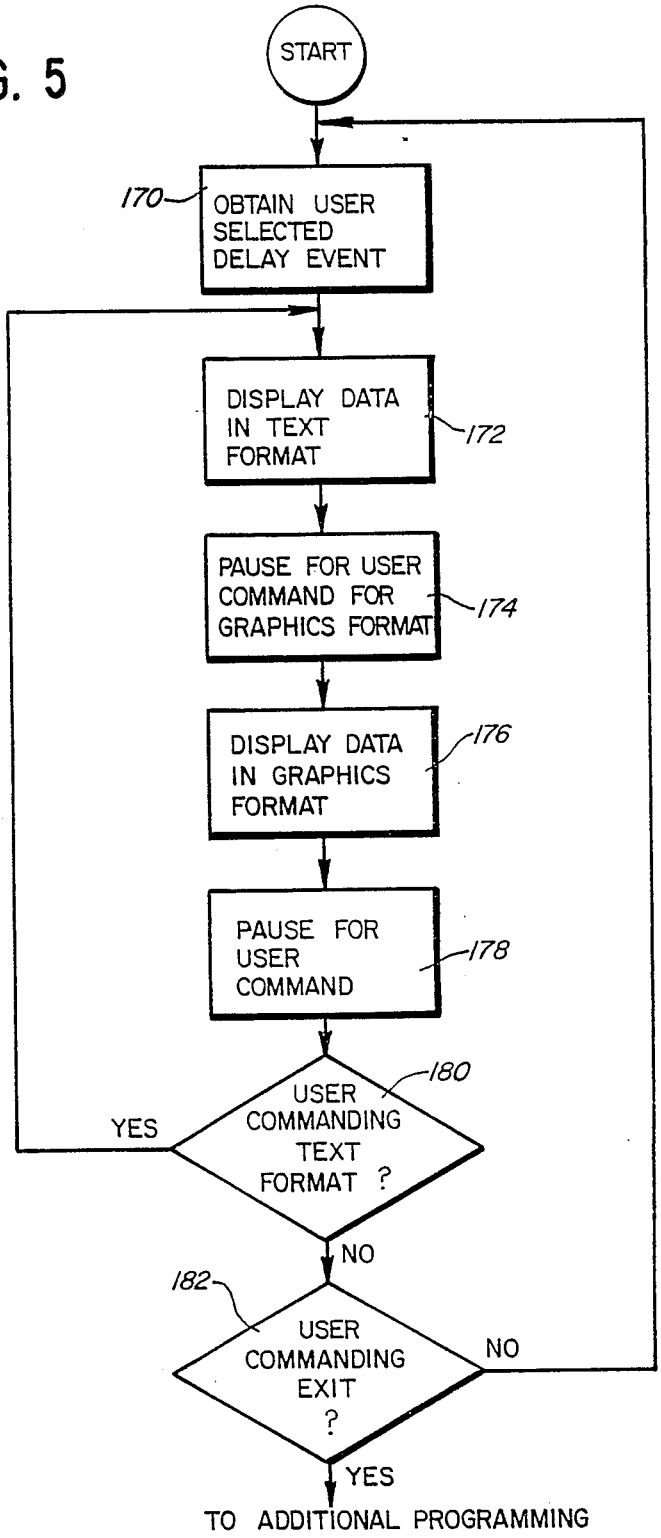
FIG. 5 is a flow chart of programming executed by the diagnostic display system of FIG. 2 to control the presentation of data on the video display terminal (VDT) of FIG. 2.

Referring now to FIG. 5, there is illustrated a portion of the main program of the diagnostic display system 58 for controlling the display of data on the VDT 53. Control begins at a block 170 which operates VDT 53 to prompt the user to select a particular delay event for viewing. This may be accomplished through a series of menus, if desired. Once the user selection has been obtained, a block 172 operates the VDT 53 to display the operating condition status relative to the selected delay event in a text format. Control then pauses at a block 174 until the user issues a command to view the data in a graphics format. A block 176 then operates the VDT 53 to operate same in a captured event mode whereby the data is displayed in the graphics format, identical to the appearance of the display in the real time display mode when the delay event occurred. This format is essentially a frozen image stored from a previous time. The VDT 53 displays in a corner of the screen the legend "captured event screen" to alert the operator that he is viewing a past event.

Following the block 176, control pauses at a block 178 until the user issues a further command. If the user is commanding redisplay of the data in the text format, control returns to the block 172. Otherwise, control passes to a block 182 which checks to determine whether the user is commanding display of data other than the delay event data. If this is not the case, then control returns to the block 170 where the user may select a different delay event for display. Otherwise control exits the block 182 to additional programming executed by the display system 58.

FIGS. 6a–6f illustrate the appearance of the VDT 53 when displaying the status of elevator operating conditions in graphics and text formats for each of three delay events. It can be seen that the VDT displays the status of operating conditions relative to the operation of each car individually and to the operation of the cars as a group. Referring specifically to FIG. 6A which illustrates the appearance of the VDT 53 in the graphics format, the display includes a diagrammatic representation of each car (here comprising three cars 12a, 12b, and 12c) and a diagrammatic representation of the hoistways (comprising hoistways 16a–16d). Boxes 200a–200c are displayed representing the position of the elevator cars 12a–12c in the hoistways at 16a–16c. Also displayed in the hoistway is a symbol or icon 202 representing a car call placed at the control panel of the elevator car 16b. The position of the symbol 202 at the first landing indicates that a request has been issued at the control panel of the elevator car 12b to command such car to move to the first floor and to open the car doors.

In addition to the foregoing, indications of hall calls are provided by highlighting floor designations adjacent the representation of the hoistways. Thus, for example, as indicated by the highlighted numeral one in an up direction column, a request has been entered by a user for elevator service in the up direction at the first floor. Likewise, a request has been entered on the fifth floor for elevator service in the down direction.

Disposed adjacent the representation of each elevator car 12a–12c is information concerning the position and direction of movement of the elevator car and its mode of operation, including an indication of whether such car is experiencing a delay event. Thus, for example, a "7" is located adjacent the first elevator car 12a together with an indication that the car is delayed due to independent service.

Similarly, an "L" with a down arrow is disposed adjacent the second car 12b together with an indication that the car is operating in the normal mode to designate that such car is in use and is traveling downward at floor L.

In like fashion, the designation "L" and and an up arrow together with the indication "normal mode next up" designates that the third car 12c is currently located at floor L and will proceed in the up direction.

The representation of each elevator car also includes a representation concerning the open/closed status of the elevator car doors. Thus, the car doors of car 12a are fully opened whereas the doors of elevator car 12b are partially closed and the car doors of elevator car 12c are fully closed.

Further, the screen includes in the lower left-hand corner an indication of the common operational mode (i.e. "balanced") and an indication of the beginning time and date of the delay event is provided in the lower right-hand corner.

Provision is also made for displaying one or more future cars which may be added to the elevator system. Thus, a fourth car designated "future car" is displayed on the right-hand portion of the display.

As should be evident from the foregoing, the graphics format permits a user to quickly identify the source of the delay event together with the elevator operating conditions which were in existence at the beginning of such delay event. The information may alternatively be described in the text format of FIG. 6B which includes a plurality of text fields at which various items of information are displayed. An identification of the car experiencing the delay event is indicated in the uppermost field of the display. Time and date fields for the beginning and ending of the delay event are provided immediately thereunder. Displayed in the next field is an indication of the probable cause of the delay event. This cause is selected from the following list:

Stop Switch
Hatch Access
Car Top Inspection
Independent Service
Safety String
Front Photocell
Rear Photocell
Front Door Open Button
Rear Door Open Button
Front Door Safety Edge
Rear Door Safety Edge
Front Door Obstruction
Rear Door Obstruction
Timed out of Service Emergency Power
In Car Hospital Service
Hospital Service
Freight Service
Seismic
Phase II Fire Service
Phase I Fire Service
Hall Shutdown Switch
Car Shutdown Switch
Lobby Return
Normal.

The foregoing list is prioritized in the sense that if two conditions are detected, the detected cause which is higher in the list will be displayed in the probable cause of event field. Thus, if both the stop switch 76 and the safety string 104 are not in the normal operating state, the display system 56 will display the stop switch as the probable cause of event.

Located below the probable cause of event field is a series of fields which indicate the status of various operating conditions. These conditions are detected by the devices illustrated in FIG. 2 or are detected by the common 55 itself. Thus, for example, a determination as to whether the car and door gates are open, the safety edge is normal, the photocell is not broken, etc. is obtained by sensing the inputs to the control 30*a*. A determination as to whether the car is moving is readily available to the common 55.

In addition to the foregoing, a determination is made whether the car has not timed out of service. Briefly, each control 30 includes a timer 280*a*, 280*b* for each elevator car which is reinitialized and enabled when the car doors are opened at a landing. If, for some reason, the car doors cannot be closed within a certain period of time following opening thereof, the timer for that car expires. Thus it is assumed by the common 55 that the car cannot be placed into service and hence further car operation is prevented. This status is indicated in the operator condition status fields but is not a condition which is detected due to the status of switches or buttons.

Further conditions which may be indicated and which are sensed by the common 55 directly include an emergency power mode, during which time the elevator system is running on emergency power, and a plurality of service modes including in-car hospital service, hospital service, freight service, two different types of fire service modes (referred to as phase I and phase II modes) and other types of service modes. In addition to the foregoing, the common 55 may operate a car in a "lobby return" mode during which the car doors are closed and the car is returned to the lobby due to sensing of a particular condition. These service modes may also be indicated in the text fields or may be included on the graphic display format.

FIGS. 6C and 6E illustrate the appearance of the display in the graphics mode for other delay events. FIGS. 6D and 6F illustrate the appearance of the VDT 72 for such delay events in the text format. Referring specifically to FIG. 6C, there is provided an indication that the first car is delayed in responding to a request for service due to sensing by the photocell of an obstruction in the car doors. This probable cause is indicated in the probable cause of event field in FIG. 6D. Further, an indication is made in the lower text fields that the photocell light beam is broken which provides another indication of the probable cause of the delay.

For the delay event of FIGS. 6E and 6F, there is an indication below the representation of the elevator car 12*b* that such car is delayed in responding to a request for service due to actuation of the front door open button 74. This is listed in the probable cause of event field of FIG. 6F together with an indication in the lower status fields that the door open button has been pushed.

It can be seen that each of the display formats displays the status of each operating condition at a selected location or field on the VDT. Significantly, the selected location or field is the same for each delayed car response, and hence understanding of the data presented on the screen is facilitated.

We claim:

1. In an elevator system in which one or more elevator cars respond to requests for service wherein the status of one or more of a plurality of operating conditions of the elevator system may delay car response, a diagnostic display system for indicating the status of the elevator system operating conditions, comprising:

means for developing signals representing each operating condition;

means responsive to the developing means for detecting a delay of car response;

means responsive to the detecting means for storing the signals representing each operating condition when a delayed car response is detected; and means coupled to the storing means for indicating the status of the operating conditions as they were at the time of a delayed car response.

2. The diagnostic display system of claim 1, wherein the indicating means includes means for displaying the identity of the car which was delayed and the probable cause of a delayed car response.

3. The diagnostic display system of claim 1, wherein the indicating means includes means for displaying the time at which a delay of car response occurred.

4. The diagnostic display system of claim 1, wherein each elevator car includes a door movable between opened and closed positions and wherein the indicating means includes means for displaying whether each door is opened or closed.

5. The diagnostic display system of claim 1, wherein each elevator car is capable of operation in a normal mode during which a common dispatching unit coordinates the handling of service requests or in an independent mode during which service requests are handled by each car individually and wherein the indicating means includes means for displaying whether the cars are operating in the normal or indepenent mode.

6. The diagnostic display system of claim 1, wherein the system is implemented by a processing unit connected to a video display terminal (VDT) and wherein the indicating means includes means for displaying the status of the operating conditions in more than one screen format on the VDT.

7. The diagnostic display system of claim 6, wherein the displaying means is operable in first and second display modes to display the status of the operating conditions in a graphics format or in a text format, respectively.

8. The diagnostic display system of claim 7, wherein the elevator cars travel in a hoistway and wherein the displaying means, when operating in the first display mode, displays a diagrammatic representation of each elevator car and the position of each car in the hoistway.

9. The diagnostic display system of claim 7, wherein requests for elevator service are initiated by hall and/or car calls and wherein the displaying means, when operating in the first display mode, displays the status of hall and car calls and the direction of travel of each car in the hoistway.

10. The diagnostic display system of claim 9, wherein the elevator cars may be controlled by a common dispatching unit in one of a plurality of common operational modes and wherein the displaying means, when operating in the first display mode, displays the common operational mode that the cars are being controlled in.

11. The diagnostic display system of claim 7, wherein the displaying means, when operating in the second display mode, displays the length of time a car is delayed in responding to a request for service.

12. The diagnostic display system of claim 7, wherein the elevator system includes safety devices which prevent operation of an elevator car when a potentially unsafe condition is detected and wherein the displaying means, when operating in the second display mode, displays the status of the safety devices.

13. The diagnostic display system of claim 1, wherein the indicating means includes means for displaying the status of each operating condition at a selected location on a video display terminal (VDT) whereby the selected location is the same for each delayed car response.

14. A diagnostic display system for indicating the status of elevator system operating conditions wherein one or more elevator cars of a group respond to requests for service, comprising:

first means for displaying the status of elevator operating conditions in a particular format on the display as the elevator system is operating;

means for detecting delay events each of which occurs when a car is delayed in responding to a request for service;

means responsive to the detecting means for storing data representing the current status of elevator system operating conditions each time a car is delayed in responding to a request for service wherein the operating conditions relate to operation of each car individually and to operation of the cars as a group;

means coupled to the storing means for retrieving stored data representing the status of elevator operating conditions as such conditions were at the time of a selected delay event; and second means coupled to the retrieving means for displaying the status of the elevator operating conditions represented by the retrieved data in the particular format.

15. The diagnostic display system of claim 14, wherein the first and second displaying means includes means for indicating the probable cause of the delay event.

16. The diagnostic display system of claim 14, wherein the first and second displaying means are also capable of displaying the status of elevator operating conditions in a format different than the particular format.

* * * * *